US009574530B2

(12) United States Patent
Oohashi

(10) Patent No.: US 9,574,530 B2
(45) Date of Patent: Feb. 21, 2017

(54) FUEL PUMP MODULE AND METHOD OF MANUFACTURING THE SAME

(71) Applicant: DENSO CORPORATION, Kariya, Aichi-pref (JP)

(72) Inventor: Masaharu Oohashi, Takahama (JP)

(73) Assignee: DENSO CORPORATION, Kariya (JP)

( * ) Notice: Subject to any disclaimer, the term of this patent is extended or adjusted under 35 U.S.C. 154(b) by 140 days.

(21) Appl. No.: 14/470,004

(22) Filed: Aug. 27, 2014

(65) Prior Publication Data

US 2015/0059705 A1 Mar. 5, 2015

(30) Foreign Application Priority Data

Aug. 28, 2013 (JP) ..... 2013-176922

(51) Int. Cl.

| | |
|---|---|
| ***F02M 37/04*** | (2006.01) |
| ***F02M 37/00*** | (2006.01) |
| ***F02M 37/02*** | (2006.01) |
| ***F02M 37/10*** | (2006.01) |
| ***F02M 37/18*** | (2006.01) |

(52) U.S. Cl.

CPC ..... *F02M 37/0088* (2013.01); *F02M 37/025* (2013.01); *F02M 37/106* (2013.01); *F02M 37/18* (2013.01); *Y10T 29/49236* (2015.01)

(58) Field of Classification Search

CPC ..... F02M 37/04; F02M 37/0047; F02M 37/0088; F02M 37/10; F02M 37/18

See application file for complete search history.

(56) References Cited

U.S. PATENT DOCUMENTS

2004/0065144 A1 4/2004 Mitani et al.
2005/0241617 A1* 11/2005 Kojima ..... F02D 41/3094 123/446

FOREIGN PATENT DOCUMENTS

| | | | |
|---|---|---|---|
| JP | 2006-125248 | 5/2006 | |
| JP | 2009-228653 | 10/2009 | |
| JP | 2009-243330 | 10/2009 | |
| JP | 2009243330 A * | 10/2009 | ..... F02M 37/22 |

OTHER PUBLICATIONS

U.S. Appl. No. 14/470,198, filed Aug. 27, 2014 in the name of Masaharu Oohashi.
U.S. Appl. No. 14/470,090, filed Aug. 27, 2014 in the name of Masaharu Oohashi.

(Continued)

*Primary Examiner* — Carlos A Rivera
*Assistant Examiner* — Kevin Lathers
(74) *Attorney, Agent, or Firm* — Nixon & Vanderhye PC

(57) ABSTRACT

A fuel pump module supports a port injection (PI) fuel pump and a direct injection (DI) fuel pump by utilizing a combination structure of a pump case for housing the PI fuel pump and an other pump case for housing the DI pump case. The two pump cases are combined via a support part. The support part includes an outer wall of a cylinder part of the pump case which extends outwardly toward a radially-outer portion thereof. The cylinder part houses the PI fuel pump. The support part has a C-shape, and supports the other pump case which houses the DI fuel pump, a DI filter and the like. As a result, the fuel pump module has a fewer number of parts and a reduced volume.

5 Claims, 8 Drawing Sheets

(56) References Cited

OTHER PUBLICATIONS

U.S. Appl. No. 14/469,930, filed Aug. 27, 2014 in the name of Masaharu Oohashi.
U.S. Appl. No. 14/469,965, filed Aug. 27, 2014 in the name of Masaharu Oohashi.
Office Action (2 pages) dated Jul. 9, 2015, issued in corresponding Japanese Application No. 2013-176922 and English translation (3 pages).
U.S. Appl. No. 14/470,198, filed Aug. 27, 2014, Fuel Pump Module.
U.S. Appl. No. 14/470,090, filed Aug. 27, 2014, Fuel Pump Module.
U.S. Appl. No. 14/469,930, filed Aug. 27, 2017, Fuel Pump Module.
U.S. Appl. No. 14/469,965, filed Aug. 27, 2014, Fuel Pump Module.

* cited by examiner

FUEL PUMP MODULE AND METHOD OF MANUFACTURING THE SAME

CROSS REFERENCE TO RELATED APPLICATION

The present application is based on and claims the benefit of priority of Japanese Patent Application No. 2013-176922, filed on Aug. 28, 2013, the disclosure of which is incorporated herein by reference.

TECHNICAL FIELD

The present disclosure generally relates to a fuel pump module and a method of manufacturing the same.

BACKGROUND INFORMATION

Conventionally, a fuel pump module may utilize a plurality of fuel pumps with each fuel pump having respectively different discharge pressures according to an engine operation state, for achieving a high output of the engine and/or for an improvement of the fuel mileage. That is, a patent document 1 (i.e., Japanese Patent No.: JP-A-2009-228653) discloses a fuel pump module that includes a main pump, a sub-pump, a filter that removes foreign substance from the fuel discharged from the main and/or sub-pumps, a subtank having a cylindrical shape with a bottom attached thereto and housing the main pump and the like, and a cover member that covers an opening of the subtank and supports the main pump and the like.

When the plurality of fuel pumps having respectively different discharge pressures are selectively used, preferably, each of the plurality of fuel pumps should have its own filter. In such case, the size of the subtank must be sufficiently large for housing the plurality of fuel pumps and accompanying filters, thereby increasing the size of the cover member and the size of the pump module.

SUMMARY

It is an object of the present disclosure to provide a fuel pump module having a small size while reducing the number of components used therein.

In an aspect of the present disclosure, a fuel pump module, which supplies fuel from a fuel tank to an internal-combustion engine, includes a first pump discharging fuel from the fuel tank to a combustion chamber of the internal-combustion engine, a first filter removing foreign substance from fuel that is discharged from the first pump, and a first supply port disposed at a position between the first filter and the combustion chamber and allowing fuel that has passed through the first filter to flow therethrough. The fuel pump module also includes a second pump discharging fuel from the fuel tank to an air-intake system of the internal-combustion engine, a second filter removing foreign substance from fuel that is discharged from the second pump, and a second supply port disposed at a position between the second filter and the air-intake system and allowing fuel that has passed through the second filter to flow therethrough. Further, the fuel pump module includes a first housing member housing and supporting one of the first pump or the second pump, and a support part formed on the housing member and supporting an other of the first pump or the second pump.

The fuel pump module of the present disclosure is provided with a support part formed on the first housing member that houses one of the first pump and the second pump. The support part supports the other one of the first pump and the second pump, i.e., for supporting the one that is not supported by the first housing member. Therefore, a member for supporting the first pump and a member for supporting the second pump are integrated, and the number of components for making the fuel pump module is reduced. Thus, the size of the fuel pump module that includes the plural pumps and the plural filters is reduced.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Hereafter, the embodiment of the present disclosure is described based on the drawings.

One Embodiment

Figure 1:
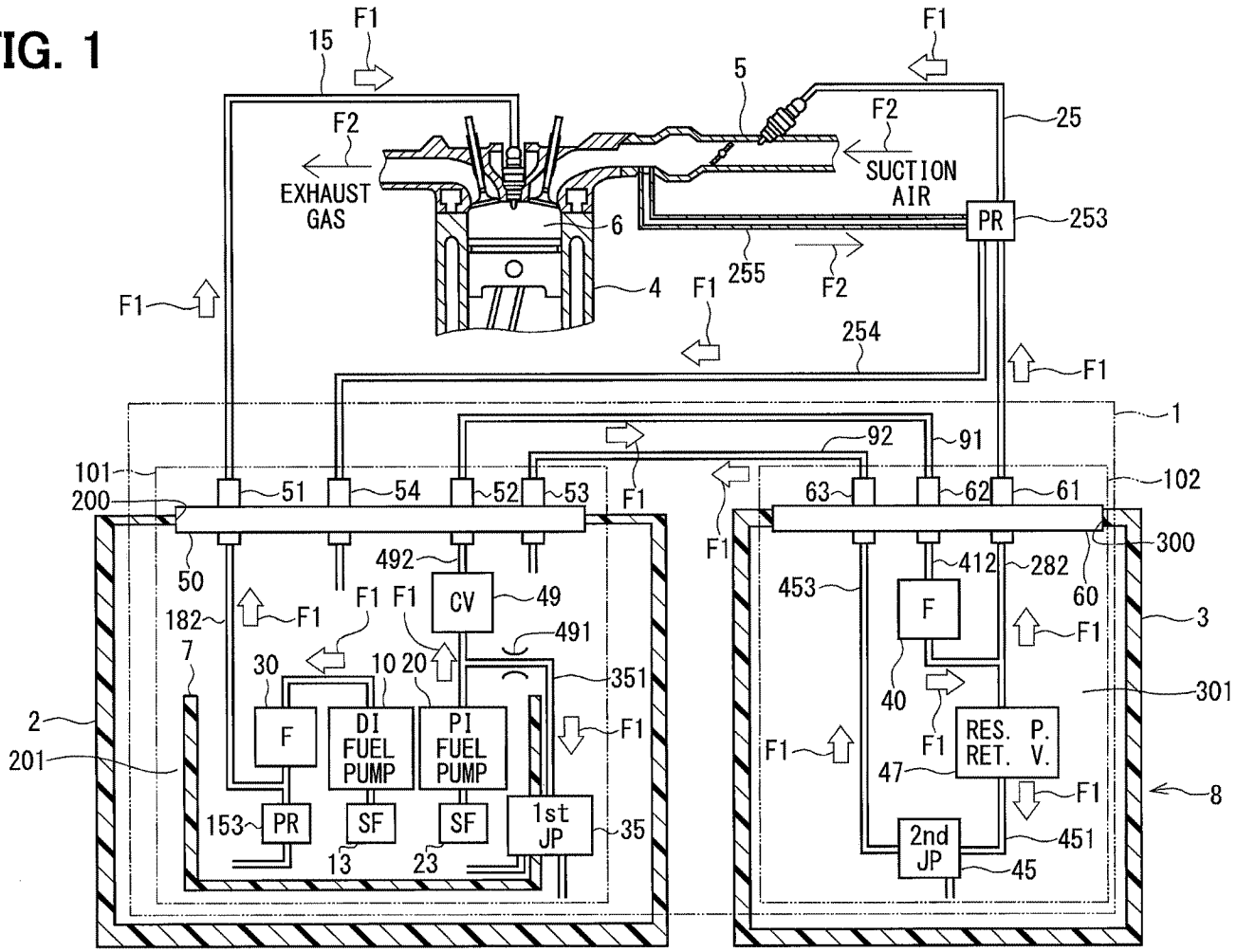
FIG. 1 is a block diagram of a system of a fuel pump module in one embodiment of the present disclosure.

The block diagram explaining a system of a fuel pump module 1 in one embodiment of the present disclosure is shown in FIG. 1. The fuel pump module 1 supplies, to an engine 4, a fuel stored by a fuel tank 8 which has two "fuel reservoir rooms", i.e., a first tank room 201 and a second tank room 301. The fuel pump module 1 supplies, to either one of a combustion chamber 6 of the engine 4 or an air-intake system 5 which is connected to the engine 4, the fuel in different pressures according to a drive state of the engine 4. The fuel pump module 1 is, as shown in FIG. 1, comprised of a first module 101 and a second module 102 together with other parts such as transport pipes 91 and 92 etc. by which the first module 101 and the second module 102 are connected for flowing the fuel back and forth between a first tank 2 and a second tank 3. Further, a white arrow F1 in FIG. 1 shows a flow of the fuel. Further, a solid line arrow F2 in FIG. 1 shows a flow of a gas.

The first module 101 is disposed in the first tank 2. The first module 101 pressurizes the fuel in the first tank 2, and supplies the pressurized fuel to the engine 4, or transports it to the second tank 3. The first module 101 comprises a suction filter 13, a direct injection fuel pump 10 (i.e., hereafter designated as a "DI fuel pump 10"), a suction filter 23, a port injection fuel pump 20 (i.e., hereafter designated as a "PI fuel pump 20"), a direct injection filter 30 (i.e., hereafter designated as a "DI filter 30"), a first jet pump 35, a first flange 50, a subtank 7, and other parts. The DI fuel pump 10 is equivalent to a "first pump" in the claims. The PI fuel pump 20 is equivalent to a "second pump" in the claims. The DI filter 30 is equivalent to a "first filter" in the claims.

The suction filter 13 comprises a saccate element part 131, a cylindrical connection part 132, etc. The suction filter 13 removes foreign substance from the fuel in the subtank 7 by using the element part 131. The connection part 132 is disposed at a position between the saccate element part 131 and the suction part 12 of the DI fuel pump 10, and is connected to the suction part 12. A connection part 132 providing a connection port 133 allows a communication between an inside of the element part 131 and a suction port 121 of the suction part 12 of the DI fuel pump 10.

The DI fuel pump 10 is an electromotive pump disposed in the subtank 7 that is accommodated in the first tank 2. The DI fuel pump 10 pressurizes the fuel in the subtank 7 to 500 kPa, for example, and directly supplies the pressurized fuel to the combustion chamber 6 of the engine 4 via a direct injection supply pipe 15 (i.e., hereafter designated as a "DI supply pipe 15") that leads to a direct injection supply port 51 (i.e., hereafter designated as a "DI supply port 51") that is disposed on the first flange 50. In the fuel pump module 1 in one embodiment, it is configured that the amount of the fuel supplied from the DI fuel pump 10 to the engine 4 is greater than the amount of the fuel supplied from the PI fuel pump 20 to the engine 4. The DI fuel pump 10 comprises the suction part 12, a pump part 14, a motor part 16, a discharge part 18, and the like. The DI supply port 51 is equivalent to a "first supply port" in the claims.

The suction part 12 is disposed on a filter side (i.e. closer to the suction filter 13) of the DI fuel pump 10, and is connected to the pump part 14 of the DI fuel pump 10. The suction part 12 has the suction port 121. The suction port 121 allows communication between an inside of the suction filter 13 and an inside of the pump part 14. The suction port 121 is disposed at an away-from-axis position (i.e., a position that is different from a position of an axis of the DI fuel pump 10), and sends the fuel in the subtank 7 via the suction filter 13 to the pump part 14.

The pump part 14 comprises an impeller which is not illustrated, a pump case 141 which forms a pump room in which the impeller is rotatably accommodated, together with other parts. The pump room allows communication between the suction port 121 of the suction part 12 and a discharge port 181 of the discharge part 18.

The motor part 16 is a brushless motor which comprises a stator, a rotor, a shaft, and the like, all of which are not illustrated. When an electric power is supplied to a not-illustrated winding which is wound on a cylindrical stator via a wire harness 161 (see FIG. 2) and a power supply terminal 162, a rotor positioned in an inside of the stator rotates together with the shaft. A rotation torque of the shaft is transmitted to the impeller of the pump part 14. In such manner, the impeller of the pump part 14 rotates, the fuel in the pump room is pressurized, and the pressurized fuel is sent to the discharge part 18.

The discharge part 18 is disposed on an opposite side of the suction part 12 relative to the pump part 14 and the motor part 16. The discharge part 18 has a discharge port 181 which allows communication between an inside of the pump part 14 and an inside of the pump case 11. The fuel pressurized by the pump part 14 is sent to a fuel passage 111 that is formed in an inside of the pump case 11 via the discharge port 181.

The pump case 11 is a cylindrical member having a bottom, which is made of resin. The pump case 11 comprises a bottom part 112, a side part 113, a connection part 119, and the like. The DI fuel pump 10 and the DI filter 30 are accommodated in an inside of the pump case 11. The pump case 11 is equivalent to a "second housing member" in the claims.

The bottom part 112 is formed substantially in a disk shape from resin. A through hole 116 is disposed on the bottom part 112 substantially in parallel with an axis of the DI fuel pump 10. The through hole 116 has a connector to be electrically connected to the power supply terminal 162 of the motor part 16 inserted therein.

Figure 4:
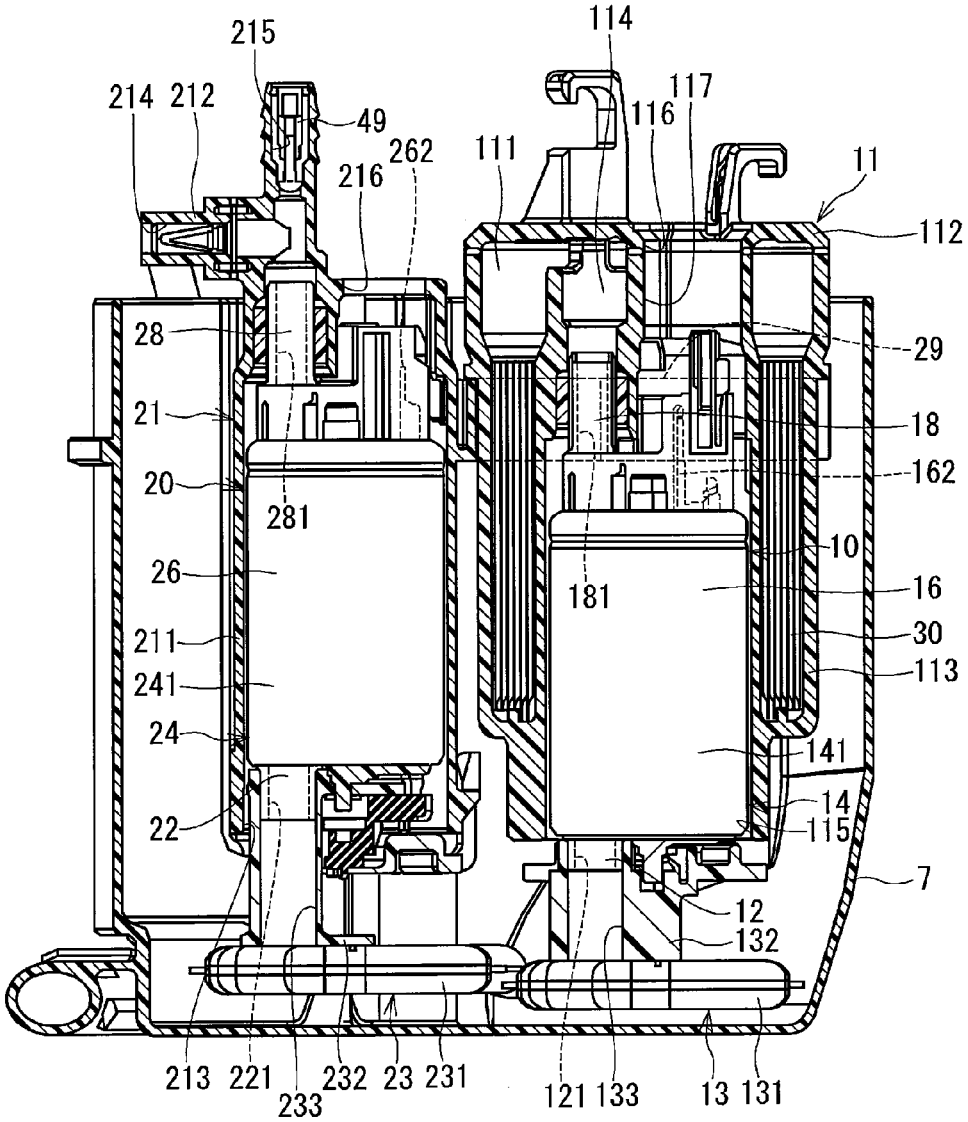
FIG. 4 is a sectional view of the first module in the fuel pump module in one embodiment of the present disclosure.

Referring to FIG. 4, the side part 113 has (i) a cylindrical space with a bottom, or a one-end-closed cylinder, with two openings, i.e., an opening 117 in communication with the through hole 116 of the bottom part 112 and an opening 115 that is formed on a filter side that is close to the filter 13, and (ii) a donut shape space, or a ring shape space, that is positioned on a radially-outer portion of the cylindrical space. In the one-end-closed cylinder, the DI fuel pump 10 is housed. The DI fuel pump 10 is housed in the one-end-closed cylinder through the opening 115. Further, through the opening 117, a connector that is electrically connected with the power supply terminal 162 is housed. At a position that corresponds to the discharge port 181 of the side part 113, a connection chamber 114 is formed for communication between the discharge port 181 and the fuel passage 111. The fuel discharged from the discharge port 181 flows through the connection chamber 114 and is sent into the fuel passage 111.

In the donut shape space of the side part 113, the DI filter 30 is housed substantially in a cylindrical shape. The DI filter 30 is made of a conductive resin which does not contain carbon, for example, and removes foreign substance from the fuel that is discharged from the discharge port 181. The fuel passing through the DI filter 30 is sent into the connection part 119 that is disposed on a radially-outer portion of the pump case 11.

The connection part 119 is disposed on a radially-outer portion of the side part 113, and houses a pressure regulating valve 153. The pressure of the fuel sent to the connection part 119 is adjusted to a desired value by the pressure regulating valve 153. The pressure adjusted fuel is then sent to an outside of the first tank 2 via a supply pipe 182 (see FIG. 1) and the DI supply port 51 that is disposed on the first flange 50.

The suction filter 23 includes a saccate element 231, a connection part 232 substantially in a cylindrical shape, and the like. The suction filter 23 removes foreign substance from the fuel in the subtank 7 by using the element 231. The connection part 232 is disposed at a position between the element 231 and a suction part 22 of the PI fuel pump 20, and is connected to the suction part 22. A connection port 233, which is provided by the connection part 232, allows communication between an inside of the element 23 and a suction port 221 which is a part of the suction part 22 of the PI fuel pump 20.

The PI fuel pump 20 is an electromotive pump disposed in the subtank 7 of the first tank 2 similar to the DI fuel pump 10. The PI fuel pump 20 pressurizes the fuel in the subtank 7 to an arbitrary pressure level between 350 and 500 kPa, for example, and sends the fuel to the second tank 3 via a transport pipe 91 that leads to a transport port 52 disposed on the first flange 50, and, at the same time, supplies the pressurized fuel to the first jet pump 35 that is mentioned later. The PI fuel pump 20 comprises the suction part 22, a pump part 24, a motor part 26, a discharge part 28, and the like.

The suction part 22 is disposed on a filter side of the PI fuel pump 20, close to the suction filter 23, of the PI fuel pump 20, and is connected to the pump part 24 of the PI fuel pump 20. The suction part 22 has the suction port 221. The suction port 221 allows communication between an inside of the suction filter 23 and an inside of the pump part 24. The suction port 221 is disposed at an away-from-axis position, i.e., a position that is different from a position of an axis of the PI fuel pump 20, and sends the fuel in the subtank 7 via the suction filter 23 to the pump part 24.

The pump part 24 comprises an impeller which is not illustrated, a pump case 241 which forms a pump room, in which the impeller is rotatably accommodated, together with other parts. The pump room allows communication between the suction port 221 of the suction part 22 and a discharge port 281 of the discharge part 28.

The motor part 26 is a brushless motor which a stator, a rotor, a shaft, and the like, all of which are not illustrated. When an electric power is supplied to a not-illustrated winding which is wound on a cylindrical stator via a wire harness 261 (see FIG. 2) and a power supply terminal 262, a rotor provided in an inside of the stator rotates together with the shaft. A rotation torque of the shaft is transmitted to the impeller of the pump part 24. In such manner, the impeller of the pump part 24 rotates, the fuel in the pump room is pressurized, and the pressurized fuel is sent to the discharge part 28.

The discharge part 28 is disposed on an opposite side of the suction part 22 relative to the pump part 24 and the motor part 26. The discharge part 28 has the discharge port 281 which allows communication between an inside of the pump part 24 and an inside of the pump case 21. The discharge part 28 is connected to a connection part 212 that is formed in an inside of the pump case 21. The fuel pressurized by the pump part 24 is sent to the connection part 212 through the discharge port 281.

The pump case 21 is a cylindrical member having a bottom, which is made of resin. The pump case 21 comprises a cylinder part 211, a connection part 212, a support part 29 and the like. The pump case 21 is equivalent to a "first housing member" in the claims.

The cylinder part 211 has a cylindrical shape having a bottom. On one side of the cylinder part 211 close to the suction filter 23, an opening 213 is formed. The PI fuel pump 20 is inserted into an inside of the pump case 21 through the opening 213. On the other side of the cylinder part 211, i.e., a far side relative to the suction filter 23, a through hole 216 is formed. The through hole 216 receives a connecter inserted therein to be connected to a power supply terminal 262 of the motor part 26.

The connection part 212 disposed on the other side of the cylinder part 211, i.e., a far side relative to the suction filter 23, at a position that is different from the through hole 216. The connection part 212 has a flow passage that branches into two directions. One of the two branches, i.e., a flow passage 214, communicates with an inside of the first jet pump 35 via a supply pipe 351 (see FIG. 1 and FIG. 2) having an orifice 491. The other one of the two branches, i.e., a flow passage 215 houses a non-return valve 49 that regulates a flow of the fuel in one way. The fuel flowing in the other passage 215 is sent to an outside of the first tank 2 via a transport pipe 492 (see FIG. 1 and FIG. 2) and the transport port 52 disposed on the first flange 50.

Figure 3:
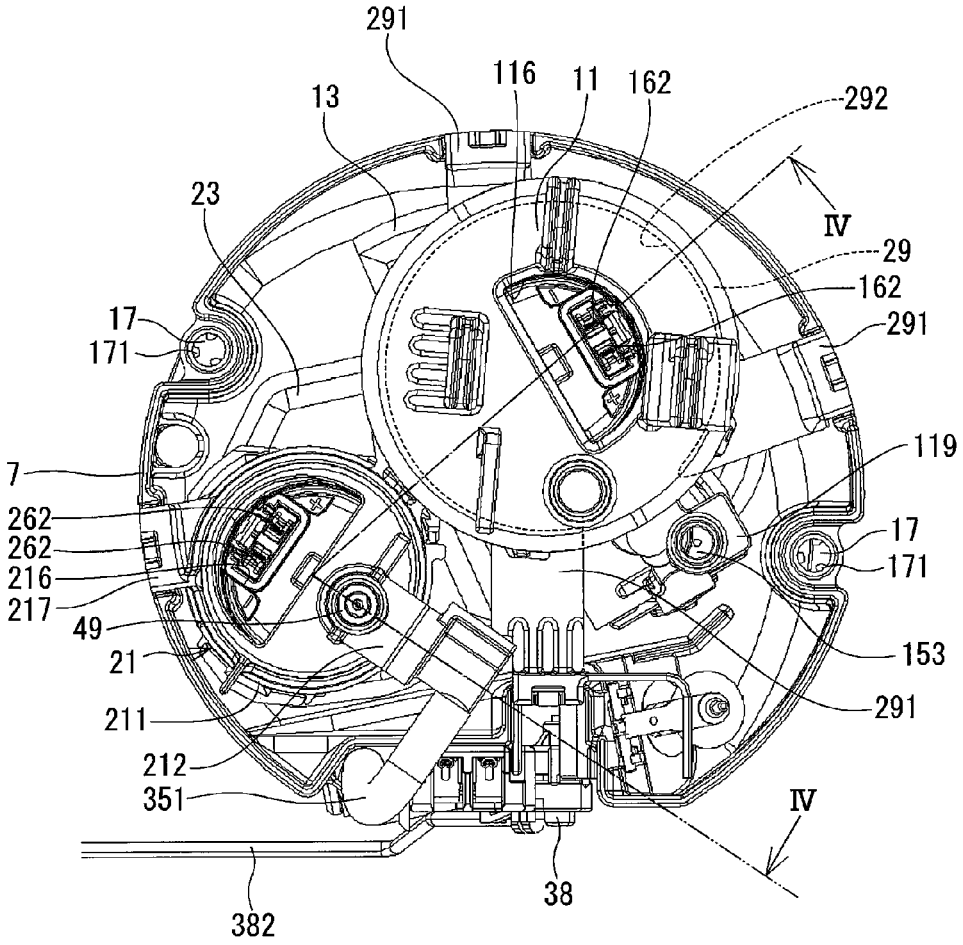
FIG. 3 is a top view of the first module in the fuel pump module in one embodiment of the present disclosure.

As shown in FIG. 4, the support part 29 is formed to extend from an outer wall of the cylinder part 211. As shown in FIG. 3, the support part 29 is substantially in a C-shape in its cross section that is perpendicular to an axis of the PI fuel pump 20. The support part 29 supports the pump case 11 that houses the DI fuel pump 10 and the DI filter 30.

Figure 8A:
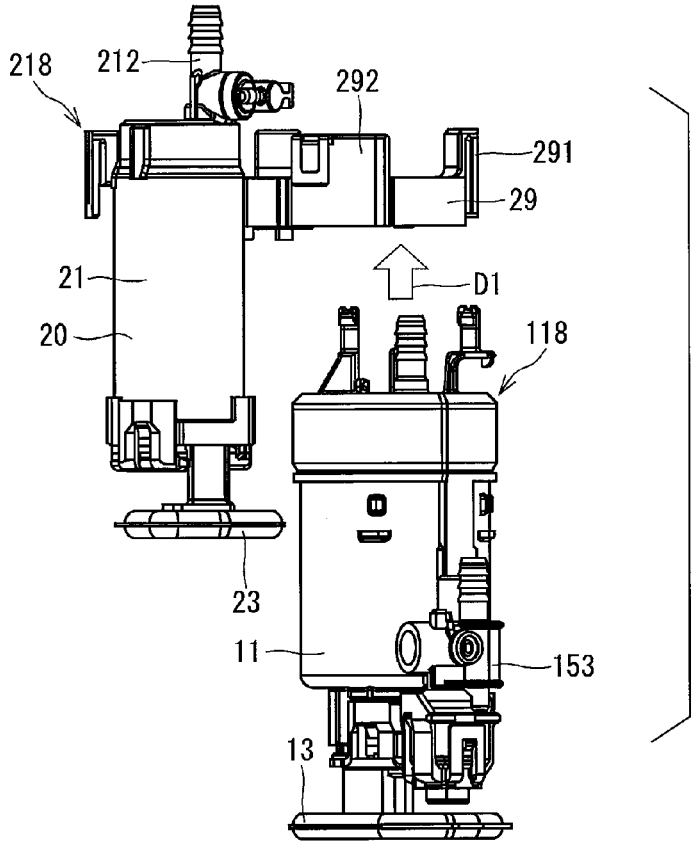
FIG. 8A is an illustration of an assembly procedure for assembling the fuel pump module.
Figure 8B:
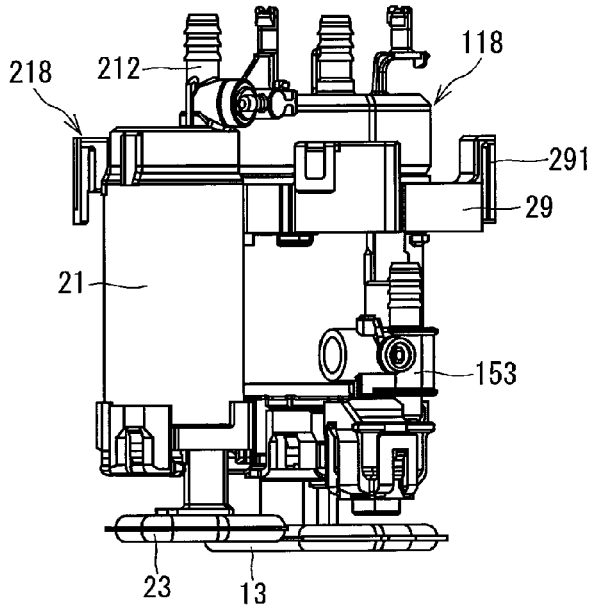
FIG. 8B is another illustration of the assembly procedure for assembling the fuel pump module.

The assembly of the fuel pump module 1 in one embodiment of the present disclosure is performed in the following manner. That is, as a "first process" in the claims, a first sub-assembly 118 in FIGS. 8A and 8B is assembled by attaching the DI fuel pump 10, the DI filter 30, the suction filter 13, etc. onto the pump case 11. In other words, the first sub-assembly 118 integrally combines the DI fuel pump 10, the DI filter 30, the suction filter 13, etc. onto the pump case 11 as a single body (i.e., an integrated, unified, and linked body). Further, as a "second process" in the claims, a second sub-assembly 218 in FIGS. 8A and 8B is assembled by attaching the PI fuel pump 20, the suction filter 23, etc. onto the pump case 21. In other words, the second sub-assembly 218 integrally combines the PI fuel pump 20, the suction filter 23, etc. onto the pump case 21 as a single body (i.e., an integrated, unified, and linked body). Then, as indicated by a white arrow D1 in FIG. 8A, the first sub-assembly 118 is combined with the second sub-assembly 218 by inserting the first sub-assembly 118 from one side of the second sub-assembly 218 close to the suction filter 23 into an insertion hole 292 that is positioned on a radially-inner portion of the support part 29. Then, the first sub-assembly 118 and the second sub-assembly 218 are assembled onto the first flange 50 as shown in FIG. 8B. An assembly direction of assembling the first sub-assembly 118 onto the second sub-assembly 218 is not necessarily limited to a direction of the white arrow D1.

Three stays 291 are formed on a radially-outer portion of the support part 29, which respectively extend toward a radially-outer portion of the first sub-assembly 118, as shown in FIG. 3. Further, on an opposite side of the cylinder part 211 relative to a part that is connected to the support part 29, a stay 217 is formed as shown in FIG. 3. The stay 217 and the stays 291 are, as shown in FIG. 3, connected to the subtank 7. In such manner, a position of the PI fuel pump 20 is accommodated in the pump case 21 and positions of the DI fuel pump 10 and the DI filter 30, that are supported by the support part 29, are respectively fixed relative to the subtank 7.

Figure 2:
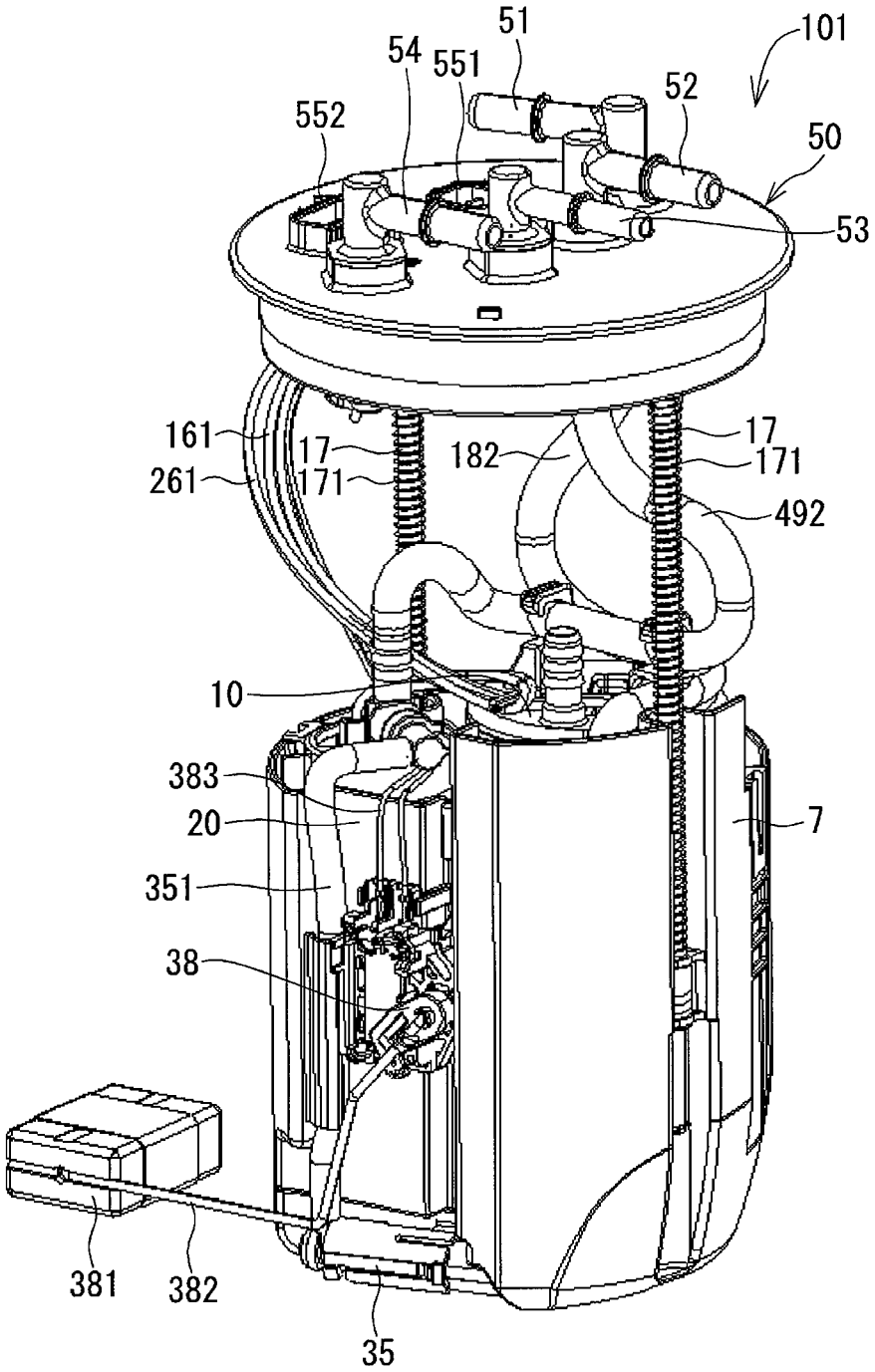
FIG. 2 is a perspective view of a first module in the fuel pump module in one embodiment of the present disclosure.

As shown in FIG. 2, the first jet pump 35 is disposed on the other side of the subtank 7 relative to the first flange 50, at a radially-outer portion position of the subtank 7. The first jet pump 35 introduces the fuel from the first tank room 201 to the subtank 7 with a help of the pressure of the discharged fuel from the PI fuel pump 20. In other words, the first jet pump 35 is in fluid communication with the PI fuel pump 20 such that the first jet pump 35 suctions fuel according to pressure from the PI fuel pump 20.

A sender gauge 38 is disposed at a radially-outer portion of the subtank 7, as shown in FIGS. 2 and 3. The sender gauge 38 is connected with a float 381 via an arm 382. When the float 381 moves according to a change of a fuel level, the arm 382 rotates, and the fuel level is detected based on a detection of the rotation amount of the arm 381 by the sender gauge 38. The sender gauge 38 outputs a fuel-level detection signal via a wire harness 383 and the first flange 50 to a non-illustrated electrical control unit (i.e., hereafter an "ECU") which is disposed externally to the module 101.

The first flange 50 is formed in a disk shape, and is positioned on an opening 200 of the first tank 2, which is "one opening" and serves as a cover of the opening 200 (see FIG. 1). A transport port 53 through which the fuel flows from the second tank 3 to the subtank 7 is provided on the first flange 50. A reflux port 54 which allows a reflux of the fuel flowing from a pressure regulating valve 253 disposed in a port injection supply pipe 25 (i.e., hereafter a "PI supply pipe 25") back to the subtank 7 is also provided on the first flange 50. In addition, the DI supply port 51 and the transport port 52 are also provided on the first flange 50. Further, on the first flange 50, an external connector 551 and an external connector 552 are disposed on the first flange 50. The external connector 551 is electrically connected to the wire harnesses 161 and 261 and supplies an electric power to the DI fuel pump 10 and the PI fuel pump 20. The external connector 552 outputs to an outside of the module 101 a signal of the fuel level which is detected by the sender gauge 38 via the wire harness 383.

The subtank 7 is formed in a bottom-closed cylindrical shape and is made from resin. The subtank 7 houses the DI fuel pump 10, the PI fuel pump 20, and the like, as mentioned above, and, on a radially-outer portion of the subtank 7, the first jet pump 35 and the sender gauge 38 are disposed.

As shown in FIG. 2, the first flange 50 and the subtank 7 are connected by two shafts 17 so that a relative position of the two (i.e., the flange 50 and the subtank 7) is changeable. On a radially-outer portion of the shaft 17, a spring 171 biasing the first flange 50 and the subtank 7 away from each other is disposed. Thereby, the subtank 7 is pressed against a bottom of the first tank 2.

The second module 102 is disposed in the second tank 3. The second module 102 removes foreign substance from the fuel that is sent from the first tank 2 and supplies the fuel to the engine 4, and/or transports the fuel from the second tank 3 to the first tank 2 with a help of the pressure of the fuel that is sent from the first tank 2. The second module 102 is provided with a port injection filter 40 (i.e., hereafter a "PI filter 40"), a filter case 41, a residual pressure maintenance valve 47, a second jet pump 45, a second flange 60, and the like. The PI filter 40 is equivalent to a "second filter" in the claims.

The PI filter 40 is substantially formed in a cylindrical shape, and is housed in the donut shape space in the filter case 41, which has the same shape as the pump case 11 housing the DI fuel pump 10. The PI filter 40 is, for example, made from a conductive resin which does not contain carbon. The PI filter 40 removes foreign substance from the fuel that is sent from the first tank 2.

Figure 7:
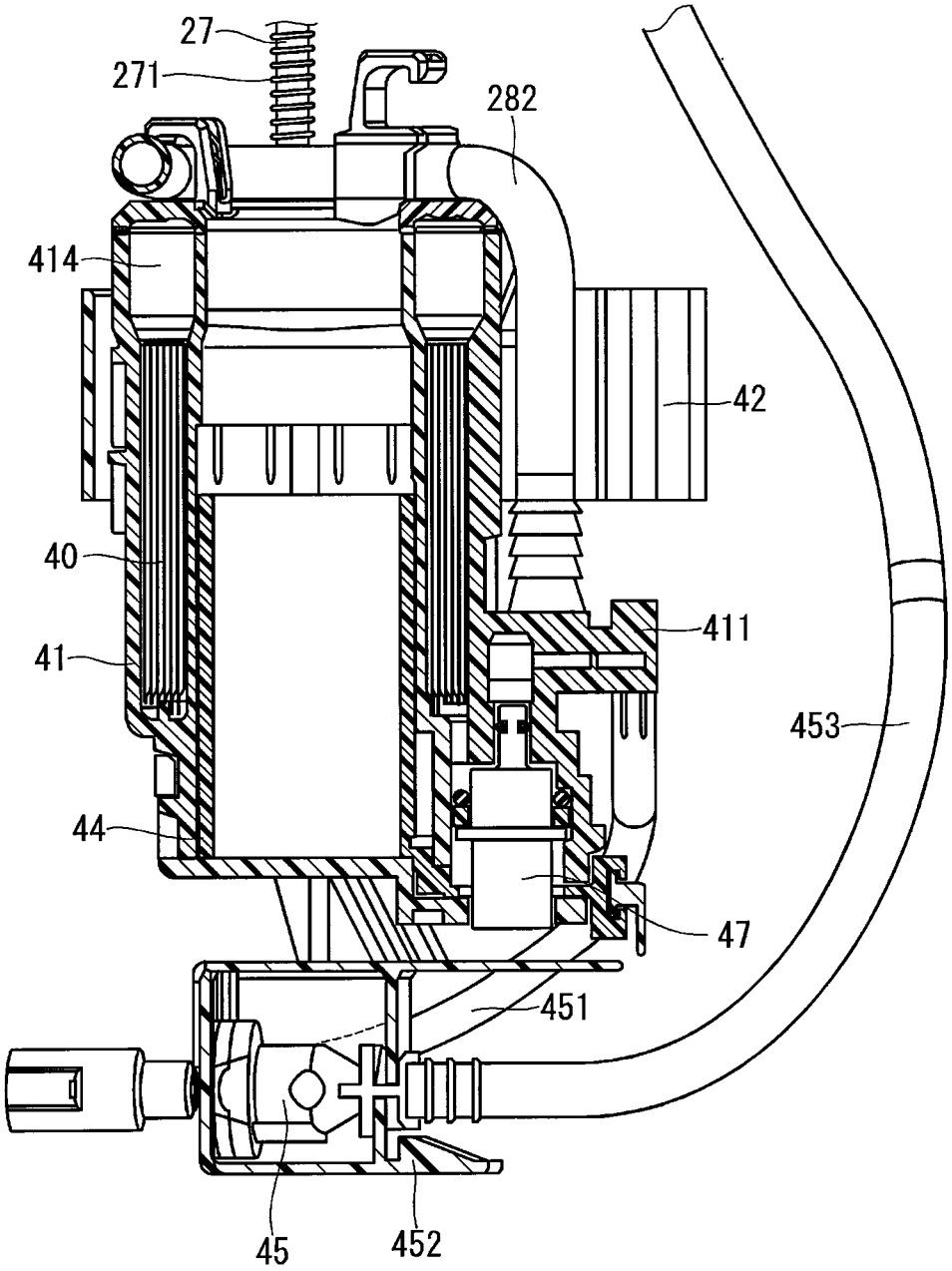
FIG. 7 is a sectional view of the second module in the fuel pump module in one embodiment of the present disclosure.

The filter case 41 is supported by an outer bracket 43 via a ring-shape inner bracket 42 that is substantially in a ring shape. As shown in FIG. 7, a ground bracket 44 grounded to a ground is housed in a cylindrical space that is formed substantially at the center of the filter case 41.

The filter case 41 has, disposed thereon, a transport pipe 412 and a transport port 413, which introduce the fuel from the first tank 2 via a transport port 62 on the second flange 60 into an inside of the filter case 41. The fuel introduced into the filter case 41 through the transport port 413 passes through a fuel passage 414 and the PI filter 40 in an inside of the filter case 41. The fuel passing through the PI filter 40 is supplied to the air-intake system 5 of the engine 4 via a supply pipe 282, a port injection supply port 61 (i.e., hereafter a "PI supply port 61") disposed on the second flange 60, and the PI supply pipe 25 connected to the PI supply port 61. Further, a part of the fuel which passes the PI filter 40 is introduced into the residual pressure maintenance valve 47 that is housed in a radially-outer portion of the filter case 41. The PI supply port 61 is equivalent to a "second supply port" in the claims.

The residual pressure maintenance valve 47 is housed in a connection part 411 disposed on a radially-outer portion of the filter case 41, as shown in FIG. 7. The residual pressure maintenance valve 47 maintains a pressure of the fuel in an inside of the PI filter 40, which is disposed on an upstream side of the valve 47, at a certain constant level such as 320 kPa, for example, and prevents the fuel in the PI filter 40 from evaporating. The fuel passing through the residual pressure maintenance valve 47 is sent to the second jet pump 45 through a supply pipe 451.

The second jet pump 45 is housed in a subtank 452 that is disposed on an opposite side of the second flange 60 relative to the outer bracket 43 (i.e., an opposite end of the module 102 relative to the second flange 60). The second jet pump 45 is a so-called push-down type jet pump, and suctions the fuel from the second tank 3 with a help of the pressure of the fuel sent from the residual pressure maintenance valve 47. The fuel suctioned by the second jet pump 45 is sent to an outside of the second tank 3 via a transport pipe 453 and a transport port 63 that is disposed on the second flange 60.

Figure 5:
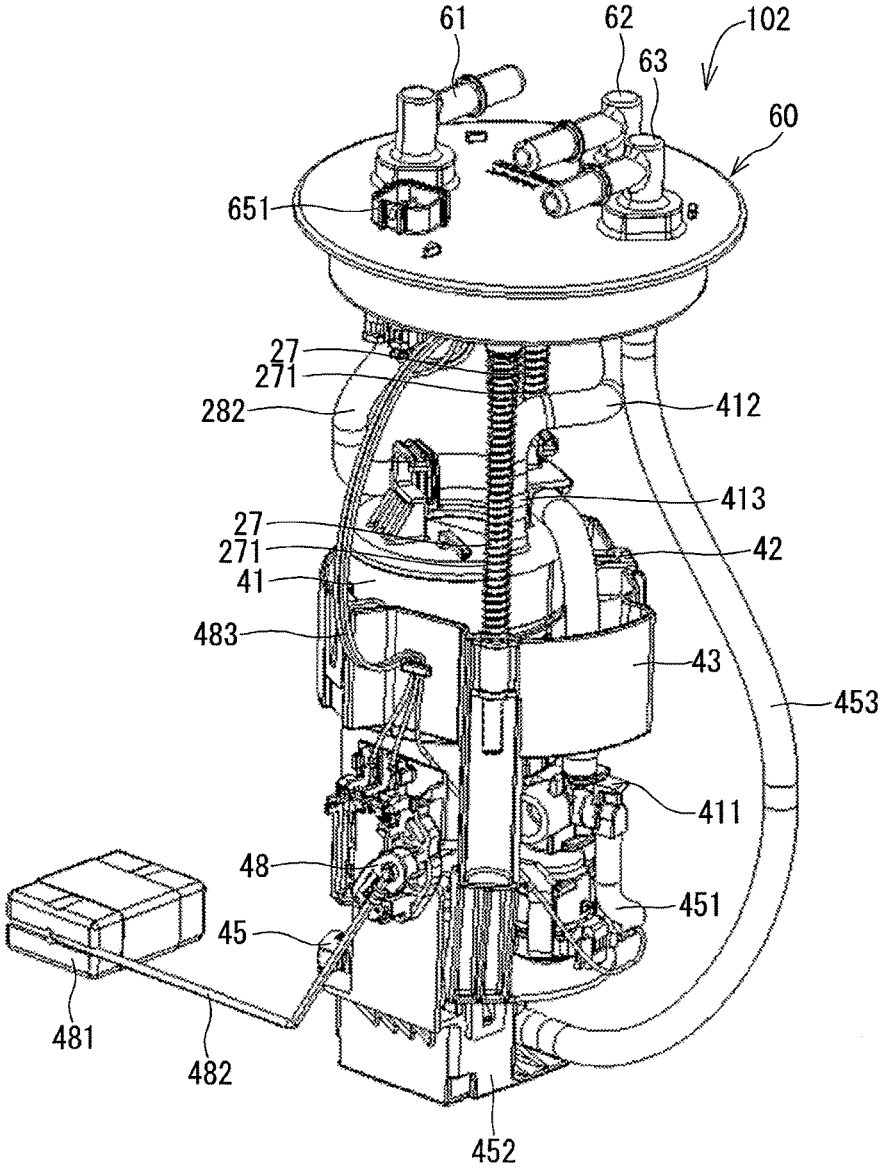
FIG. 5 is a perspective view of a second module in the fuel pump module in one embodiment of the present disclosure.
Figure 6:
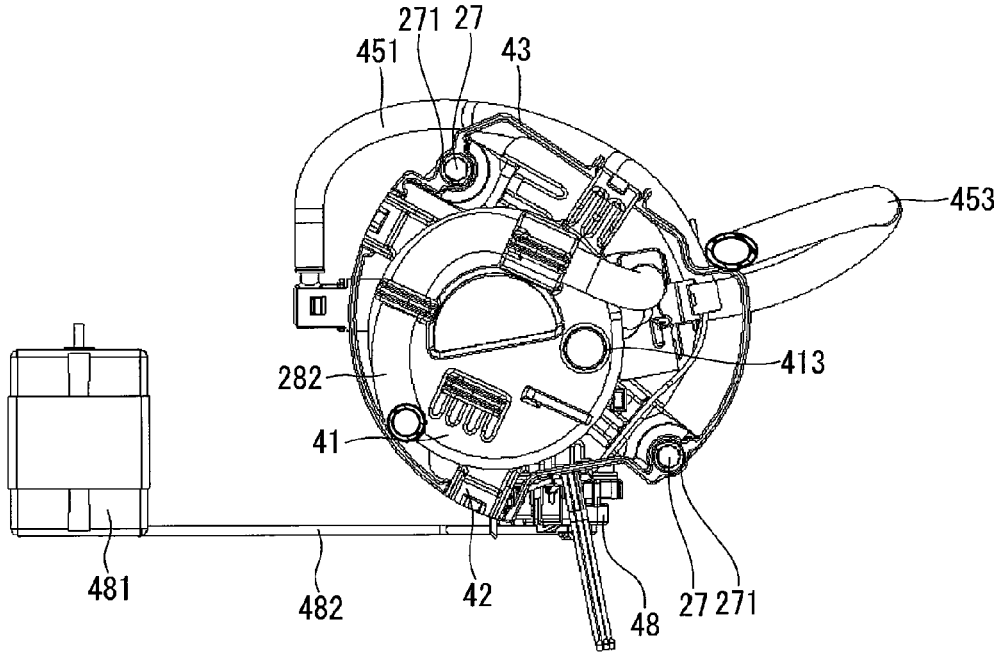
FIG. 6 is a top view of the second module in the fuel pump module in one embodiment of the present disclosure.

A sender gauge 48 is disposed on a radially-outer portion of the filter case 41, as shown in FIG. 5. The sender gauge 48 is connected to a float 481 via an arm 482. When the float 481 moves according to a change of a fuel level, the arm 482 rotates, and a fuel level is detected based on a detection of the rotation amount of the arm 482 by the sender gauge 48. The sender gauge 48 outputs a fuel-level detection signal via the second flange 60 to the ECU that is external to the module 102.

The second flange 60 is formed in a disk shape, and it is put on an opening 300 of the second tank 3, which is an "other opening" and serves as a cover of the opening 300. On the second flange 60, the PI supply port 61 as well as transport ports 62 and 63 are disposed. Further, on the second flange 60, an external connector 651 which outputs a fuel level signal detected by the sender gauge 48 via a wire harness 483 to an outside of the module 102 is disposed.

In the fuel pump module 1, the transport port 52 on the first flange 50 and the transport port 62 on the second flange 60 are connected with each other by the transport pipe 91 through which the fuel flows from the first tank 2 to the second tank 3. Further, the transport port 53 on the first flange 50 and the transport port 63 on the second flange 60 are connected with each other by the transport pipe 92 through which the fuel flows from the second tank 3 to the first tank 2. In such manner, the fuel in the second tank 3 is transported to the first tank 2 in which two fuel pumps are provided, and the fuel in both of the first tank 2 and the second tank 3 is securely supplied to the engine 4.

The second flange 60 and the filter case 41 are connected by two shafts 27 as shown in FIG. 5. On a radially-outer portion of the shaft 27, a spring 271 biasing the second flange 60 and the filter case 41 away from each other is disposed. Thereby, the filter case 41 is pressed against a bottom of the second tank 3 by the spring 271 which biases the case 41 away from the second flange 60.

The operation of the fuel pump module 1 is described in the following.

When an electric power is supplied from outside of the module 1 to the DI fuel pump 10 and the PI fuel pump 20 via the external connector 551, the DI fuel pump 10 and the PI fuel pump 20 are driven, and the fuel in the subtank 7 is suctioned via the suction filters 13 and 23 and pressurized.

In the DI fuel pump 10, foreign substance is removed from the fuel that is discharged from the pump part 14 by the DI filter 30 that is housed in the pump case 11. After the removal of foreign substance from the fuel by the DI filter 30, the pressure of the fuel is adjusted to a more suitable value by the pressure regulating valve 153, and the fuel having a suitable pressure is directly supplied to the combustion chamber 6 of the engine 4 through the supply pipe 182, the DI supply port 51 on the first flange 50 and the DI supply pipe 15.

On the other hand, in the PI fuel pump 20, the fuel discharged from the pump part 24 is in part transported into the second tank 3 through the transport pipe 492, the transport port 52 on the first flange 50, the transport pipe 91, the transport port 62 on the second flange 60, and the transport pipe 412, after passing through the non-return valve 49. Further, the fuel discharged from the pump part 24 is in part supplied to the first jet pump 35 through the supply pipe 351. The first jet pump 35 introduces the fuel from the first tank 2 into the subtank 7 with a help of the pressure of the supplied fuel.

Foreign substance is removed from the pressurized fuel, which is transported from the first tank 2 to the second tank 3 through the transport pipe 91, by the PI filter 40. The fuel passing through the PI filter 40 is in part supplied to the air-intake system 5 of the engine 4 through a supply pipe 282, the PI supply port 61 on the second flange 60, and the PI supply pipe 25. At this time, the pressure of the supplied fuel passing through the PI supply pipe 25 is adjusted by the pressure regulating valve 253 according to the pressure of a suction air introduced via a vent pipe 255 which is in communication with the air-intake system 5, for example. The fuel that is not going to be supplied to the air-intake system 5, due to the pressure adjustment, returns to an inside of the first tank 2 via a return pipe 254 and the reflux port 54 on the first flange 50.

Further, the fuel passing through the PI filter 40 is in part supplied to the second jet pump 45 through the residual pressure maintenance valve 47 and the supply pipe 451. The second jet pump 45 sends the fuel from the second tank 3 to the subtank 7 via the transport pipe 453, the transport port 63 on the second flange 60, the transport pipe 92, and the transport port 53 on the first flange 50 with a help of the pressure of the supplied fuel. Thereby, the fuel of the second tank room 301 is pressurized by the DI fuel pump 10 and the PI fuel pump 20 in the first tank 2, and is supplied to the engine 4.

The fuel pump module 1 in one embodiment of the present disclosure has a structure, in which the DI fuel pump 10 and the PI fuel pump 20 that are housed in the subtank 7 are supported by one pump case 21. The pump case 21 is a pump case that houses the PI fuel pump 20, and the support part 29 is provided on the pump case 21 for supporting the pump case 11 which houses the DI fuel pump 10 and the DI filter 30. Therefore, the number of the components of the fuel pump module 1 is reduced by uniting (i) the member that supports the pump case 11 and (ii) the member that supports the PI fuel pump 20. Thus, the size of the fuel pump module 1 is made smaller, while reducing its manufacturing cost.

Further, as for the fuel pump module 1 in one embodiment, a method of manufacturing the module 1 is made easier by assembling the first sub-assembly 118 and the second sub-assembly 218 by using the support part 29, after (i) assembling the first sub-assembly 118 by combining the DI fuel pump 10, the DI filter 30, the pump case 11, etc., and (ii) assembling the second sub-assembly 218 by combining the PI fuel pump 20 and the pump case 21, which facilitates an assembly of two pumps in the first module 101. Therefore, the number of steps of assembly of the fuel pump module 1 is reduced, thereby further reducing the manufacturing cost.

In the fuel pump module 1 of one embodiment, the pump case 11 that houses the DI fuel pump 10 and the filter case 41 that houses the PI filter 40 have the same shape. Thus, by standardizing the "housing members" for housing the pumps and filters in the fuel pump module 1 to have the same shape, the number of components is reduced.

Other Embodiments (a) In the above-mentioned embodiment, the fuel tank is a divided-tank type, in which two tanks, first and second, are in communication with each other through a transport pipe. However, the fuel tank may be other types, such as a saddle-shape tank in which a bottom of the fuel tank is divided into two bottom parts, making each of the two parts respectively serving as a "fuel reservoir room". In such case, "a communication passage for allowing communication between two fuel reservoir rooms (i.e., between two bottom parts)" is a corridor space that is made as a free space with a bottom of a corridor raised from the two bottom parts of the saddle-shape tank. Further, the number of "fuel reservoir rooms" is not necessarily limited to two, but may be three or more. When there is only one fuel reservoir room, the two fuel pumps and the two filters may be housed in one subtank.

(b) In the above-mentioned embodiment, the "first" pump case, in which the DI fuel pump for supplying fuel to the combustion chamber and the DI filter are housed, is supported by the support part that is a support of the "second" pump case, in which the PI fuel pump is housed. However, the relationship between the supporter and the supportee is not limited to the above. The "one" pump case in which one of the DI fuel pump and the PI fuel pump is housed may support the "other" pump case in which the other one of the DI fuel pump and the PI fuel pump is housed.

(c) In the above-mentioned embodiment, the support part of the pump case in which the PI fuel pump is housed has a stay disposed thereon. However, the disposition of the stay on the support part is not necessary.

(d) In the above-mentioned embodiment, the fuel pump module has two fuel pumps, two filters, and two supply ports. However, the number of fuel pumps, filters and supply ports may be other than two. Those components may respectively be only one, or may be arbitrary, such as two fuel pumps in combination with one filter and one supply port, for example. When one fuel pump, one filter, and one supply port are provided in the fuel pump module, the fuel pump and the filter may be housed in respectively different housing members. In such case, as described in the above, the two (respectively different) housing members may have the same shape, for the reduction of the number of components and the manufacturing cost.

The present disclosure may have other variations other than the above-described embodiments, as long as not diverting from the gist of the inventive structure of the fuel pump module.

What is claimed is:

1. A fuel pump module which supplies fuel from a fuel tank to an internal-combustion engine, the fuel pump module comprising:

a first pump discharging fuel from the fuel tank to a combustion chamber of the internal-combustion engine;

a first filter removing foreign substance from fuel that is discharged from the first pump;

a first supply port disposed at a position between the first filter and the combustion chamber and allowing fuel that has passed through the first filter to flow therethrough;

a second pump discharging fuel from the fuel tank to an air-intake system of the internal-combustion engine;

a second filter removing foreign substance from fuel that is discharged from the second pump;

a second supply port disposed at a position between the second filter and the air-intake system and allowing fuel that has passed through the second filter to flow therethrough;

a first housing housing and supporting the second pump;

a second housing housing the first pump and the first filter together without housing the second pump; and a support part formed on the second housing and supporting the first pump and the first filter.

2. The fuel pump module according to claim 1, further comprising one of:

a first sub-assembly integrally formed into a single body with (i) the second housing, the first pump, and the first filter, and a second sub-assembly integrally formed into a single body with (i) the first housing and the second pump; or a first sub-assembly integrally formed into a single body with (ii) the second housing, the second pump, and the second filter, and a second sub-assembly integrally formed into a single body with (ii) the first housing and the first pump.

3. The fuel pump module according to claim 1, wherein the first housing is a first pump case and the second housing is a second pump case.

4. A fuel pump module which supplies fuel from a fuel tank to an internal-combustion engine, the fuel pump module comprising:

a first pump discharging fuel from the fuel tank to a combustion chamber of the internal-combustion engine;

a first filter removing foreign substance from fuel that is discharged from the first pump;

a first supply port disposed at a position between the first filter and the combustion chamber and allowing fuel that has passed through the first filter to flow therethrough;

a second pump discharging fuel from the fuel tank to an air-intake system of the internal-combustion engine;

a second filter removing foreign substance from fuel that is discharged from the second pump;

a second supply port disposed at a position between the second filter and the air-intake system and allowing fuel that has passed through the second filter to flow therethrough;

a first housing housing and supporting the second pump;

a second housing housing the first pump and the first filter together;

a support part formed on the second housing and supporting the first pump and the first filter; and a subtank disposed in the fuel tank, the subtank supporting and housing the first housing that supports the second housing.

5. A method of manufacturing a fuel pump module, the fuel pump module supplying fuel from a fuel tank to an internal-combustion engine and including:

a first pump discharging fuel from the fuel tank to a combustion chamber of the internal-combustion engine, a first filter removing foreign substance from fuel that is discharged from the first pump, a first supply port disposed at a position between the first filter and the combustion chamber and allowing fuel that is filtered by the first filter to flow therethrough, a second pump discharging fuel from the fuel tank to an air-intake system of the internal-combustion engine, a second filter removing foreign substance from fuel that is discharged from the second pump, a second supply port disposed at a position between the second filter and the air-intake system and allowing fuel that is filtered by the second filter to flow therethrough, a first housing housing and supporting one of the first pump or the second pump, the first housing including a support part that supports an other of the first pump or the second pump, a second housing housing either (i) the first pump and the first filter or (ii) the second pump and the second filter, the second housing being supported by the support part, and one of:

a first sub-assembly integrally formed into a single body with (i) the second housing, the first pump, and the first filter, and a second sub-assembly integrally formed into a single body with (i) the first housing and the second pump; or a first sub-assembly integrally formed into a single body with (ii) the second housing, the second pump, and the second filter, and a second sub-assembly integrally formed into a single body with (ii) the first housing and the first pump;

the method of manufacturing the fuel pump module comprising:

one of:

assembling the first sub-assembly from (i) the second housing, the first pump, and the first filter, and assembling the second sub-assembly from (i) the first housing and the second pump; or assembling the first sub-assembly from (ii) the second housing, the second pump, and the second filter, and assembling the second sub-assembly from (ii) the first housing and the first pump; and connecting the first sub-assembly and the second sub-assembly after assembling the first sub-assembly and assembling the second sub-assembly.

* * * * *